US006302223B1

(12) United States Patent
Sinor

(10) Patent No.: US 6,302,223 B1
(45) Date of Patent: Oct. 16, 2001

(54) ROTARY DRAG BIT WITH ENHANCED HYDRAULIC AND STABILIZATION CHARACTERISTICS

(75) Inventor: L. Allen Sinor, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/413,301

(22) Filed: Oct. 6, 1999

(51) Int. Cl.[7] ..... E21B 10/44; E21B 10/60
(52) U.S. Cl. ..... 175/393; 175/394; 175/408
(58) Field of Search ..... 175/393, 394, 175/406, 408, 432

(56) References Cited

U.S. PATENT DOCUMENTS

| | | | |
|---|---|---|---|
| 2,365,941 | * 12/1944 | Crake | 175/393 |
| 2,819,043 | 1/1958 | Henderson . | |
| 3,112,803 | 12/1963 | Rowley . | |
| 4,194,790 | 3/1980 | Kenny et al. . | |
| 4,245,708 | 1/1981 | Cholet et al. . | |
| 4,368,787 | 1/1983 | Messenger . | |
| 4,492,277 | 1/1985 | Creighton . | |
| 4,498,549 | 2/1985 | Jügens . | |
| 4,540,055 | 9/1985 | Drummond et al. . | |
| 4,596,296 | 6/1986 | Matthias . | |
| 4,606,418 | 8/1986 | Thompson . | |
| 4,676,324 | 6/1987 | Barr et al. . | |

(List continued on next page.)

FOREIGN PATENT DOCUMENTS

| | | |
|---|---|---|
| 0 225 082 | 6/1987 | (EP) . |
| 0869256 A2 | 10/1998 | (EP) . |
| 0900099 A | 7/1962 | (GB) . |
| 2197676 A | 5/1988 | (GB) . |
| 2294072 A | 4/1996 | (GB) . |
| 2313863 A | 12/1997 | (GB) . |
| 2325014 A | 11/1998 | (GB) . |
| 2330599 A | 4/1999 | (GB) . |

OTHER PUBLICATIONS

Quick™ Cutter, GeoDiamond—New Technology, one page, 1997.
Diamond Bits, Chip Master Bits, Hughts Christensen, two pages, Aug. 1999.
Search, Report dated Dec. 18, 2000.

*Primary Examiner*—Hoang Dang
(74) *Attorney, Agent, or Firm*—TraskBritt

(57) ABSTRACT

A fixed cutter, or rotary drag, bit for drilling subterranean formations, exhibiting an enhanced resistance to bit balling and an improved rate of penetration. The bit includes an auger-like blade configuration, wherein positively raked, relatively tall blades lean rotationally forward to provide increased clearance and volume between the bit face and the formation to facilitate removal of cuttings coming off the tops of the cutters from the bit face. The blades are each substantially contiguous with an elongated, helical gage pad raked rotationally forwardly in the manner of the blades, the longitudinal lengths of the gage pads and the radially outer edges of the blades in combination with their slope providing a stabilizing structure which substantially completely circumferentially encompasses the bit body. The slope or pitch of the helix angle of the blade edges and gage pads may be varied as desired to optimize hydraulic efficiency, cutter requirements of directional drilling, and stability needs. The bit also includes nozzles positioned on the bit face and aimed toward the face of a blade following each respective nozzle to improve cleaning of the blades and to improve the hydraulic energy and fluid velocities along the gage. The bit also preferably includes aggressively raked superabrasive cutters having a ground relief on the substrate supporting the diamond table rotationally behind the table to minimize contact of the substrate material with the formation.

33 Claims, 5 Drawing Sheets

U.S. PATENT DOCUMENTS

| | | | | |
|---|---|---|---|---|
| 4,699,227 | | 10/1987 | Wardley . | |
| 4,727,946 | | 3/1988 | Barr et al. . | |
| 4,733,735 | | 3/1988 | Barr et al. . | |
| 4,744,426 | | 5/1988 | Reed . | |
| 4,776,411 | | 10/1988 | Jones . | |
| 4,794,994 | | 1/1989 | Deane et al. . | |
| 4,848,489 | | 7/1989 | Deane . | |
| 4,848,491 | | 7/1989 | Burridge et al. . | |
| 4,856,601 | | 8/1989 | Raney . | |
| 4,883,132 | | 11/1989 | Tibbitts . | |
| 4,887,677 | | 12/1989 | Warren . | |
| 4,913,244 | | 4/1990 | Trujillo . | |
| 4,981,184 | | 1/1991 | Knowlton et al. . | |
| 5,007,493 | | 4/1991 | Coolidge et al. . | |
| 5,078,219 | | 1/1992 | Morrell et al. . | |
| 5,099,929 | | 3/1992 | Keith et al. . | |
| 5,197,554 | | 3/1993 | Zijsling . | |
| 5,199,511 | | 4/1993 | Tibbitts et al. . | |
| 5,284,215 | | 2/1994 | Tibbitts . | |
| 5,303,785 | | 4/1994 | Duke . | |
| 5,341,888 | | 8/1994 | Deschutter . | |
| 5,433,280 | | 7/1995 | Smith . | |
| 5,443,565 | | 8/1995 | Strange, Jr. . | |
| 5,447,208 | | 9/1995 | Lund et al. . | |
| 5,486,137 | | 1/1996 | Flood et al. . | |
| 5,544,550 | | 8/1996 | Smith . | |
| 5,549,171 | * | 8/1996 | Mensa-Wilmot et al. | 175/431 |
| 5,582,261 | | 12/1996 | Keith et al. . | |
| 5,590,728 | | 1/1997 | Matthias et al. . | |
| 5,607,024 | | 3/1997 | Keith et al. . | |
| 5,651,420 | | 7/1997 | Tibbitts et al. . | |
| 5,653,300 | | 8/1997 | Lund et al. . | |
| 5,699,868 | | 12/1997 | Caraway et al. . | |
| 5,740,874 | | 4/1998 | Matthias . | |
| 5,794,725 | | 8/1998 | Trujillo et al. . | |
| 5,924,502 | | 7/1999 | Arfele et al. . | |
| 5,927,410 | * | 7/1999 | Greer et al. | 175/393 |
| 5,947,216 | | 9/1999 | Truax et al. . | |
| 6,006,845 | * | 12/1999 | Illerhaus et al. | 175/406 |
| 6,021,858 | | 2/2000 | Southland . | |
| 6,062,325 | * | 5/2000 | Taylor et al. | 175/393 |

* cited by examiner

ROTARY DRAG BIT WITH ENHANCED HYDRAULIC AND STABILIZATION CHARACTERISTICS

BACKGROUND OF THE INVENTION

1. Field of the Invention

The present invention is related to rotary drilling of subterranean formations and, more specifically, to a rotary drill bit exhibiting particularly beneficial characteristics for drilling slow drilling shales as well as for high rate of penetration drilling.

2. State of the Art

Equipment used in subterranean drilling operations is well known in the art and generally comprises a rotary drill bit attached to a drill string, including drill pipe and drill collars. A rotary table or other device such as a top drive is used to rotate the drill string from a drilling rig, resulting in a corresponding rotation of the drill bit at the free end of the string. Fluid-driven downhole motors are also commonly employed, generally in combination with a rotatable drill string, but in some instances as the sole source of rotation for the bit. The drill string typically has an internal bore extending from and in fluid communication between the drilling rig at the surface and the exterior of the drill bit. The string has an outer diameter smaller than the diameter of the well bore being drilled, defining an annulus between the drill string and the wall of the well bore for return of drilling fluid and entrained formation cuttings to the surface.

An exemplary rotary drill bit includes a bit body secured to a steel shank having a threaded pin connection for attaching the bit body to the drill string, and a body or crown comprising that part of the bit fitted on its exterior with cutting structures for cutting into an earth formation. Generally, if the bit is a fixed-cutter or so-called "drag" bit, the cutting structure includes a plurality of cutting elements including cutting surfaces formed of a superabrasive material such as polycrystalline diamond and oriented on the bit face generally in the direction of bit rotation. A drag bit body is generally formed of machined steel or a matrix casting of hard particulate material such as tungsten carbide in a (usually) copper-based alloy binder.

In the case of steel body bits, the bit body is usually machined, typically using a computer-controlled five-axis machine tool, from round stock to the desired shape, including internal watercourses and passages for delivery of drilling fluid to the bit face, as well as cutting element pockets or sockets and ridges, lands, nozzle displacements, junk slots and other external topographic features. Hardfacing is applied to the bit face and to other critical areas of the bit exterior, and cutting elements are secured to the bit face, generally by inserting the proximal ends of studs on which the cutting elements are mounted into apertures (sockets) bored into the bit face or, if cylindrical cutting elements are employed, by inserting the substrates into pockets bored into the bit face. The end of the bit body opposite the face is then threaded, made up and welded to the bit shank.

The body of a matrix-type drag bit is cast in a mold interiorly configured to define many of the topographic features on the bit exterior, with additional preforms placed in the mold defining the remainder of such features as well as internal features such as watercourses and passages. Tungsten carbide powder and sometimes other metals to enhance toughness and impact resistance are placed in the mold under a liquefiable binder in pellet form. The mold assembly, including a steel bit blank having one end inserted into the tungsten carbide powder, is placed in a furnace to liquify the binder and form the body matrix with the steel bit blank integrally secured to the body. The blank is subsequently affixed to the bit shank by welding. Superabrasive cutting elements, also termed "cutters" herein, may be secured to the bit face during the furnacing operation if the elements are of the so-called "thermally stable" type, or may be brazed by their supporting (usually cemented WC) substrates to the bit face, or to WC preforms furnaced into the bit face during infiltration. Such superabrasive cutting elements include polycrystalline diamond compacts (PDCs), thermally stable polycrystalline diamond compacts (generally termed "TSPs" for thermally stable products), natural diamonds and, to a lesser extent, cubic boron nitride compacts.

During a typical drilling operation using such a rotary bit, drilling fluid is pumped from the surface through the internal bore of the drill string to the bit (except in a reverse flow drilling configuration such as is described in U.S. Pat. No. 4,368,787, wherein drilling fluid passes down the annulus and up the interior of the drill string). In conventional bits, the drilling fluid flows out of the drill bit through a crow's foot or one or more nozzles placed at or near the bit face for the purpose of removing formation cuttings (i.e., chips of material removed from the formation by the cutting elements of the drill bit) and to cool the cutting elements, which are frictionally heated during cutting. Both of these functions are extremely important for the drill bit to efficiently cut the formation over a commercially viable drilling interval. That is, because of the weight on bit (WOB) applied by the drill string necessary to achieve a desired rate of penetration (ROP) and the frictional heat generated on the cutters due to WOB and rotation of the bit, without drilling fluid or some other means of cooling the bit, materials comprising the drill bit and particularly the cutting elements attached to the bit face would structurally degrade and prematurely fail. Moreover, even if it were possible to cool the bit without drilling fluid but no means of removing the cuttings from the bit face was employed, the cutting elements (and the bit) would simply become balled up with material cut from the formation and would not be able to effectively engage and further penetrate into the formation to advance the well bore.

The need to efficiently remove cuttings from the bit during drilling has long been recognized in the art. Junk slots formed on the exterior of the bit body adjacent the gage of the bit provide channels for drilling fluid to flow from the face of the drill bit past the gage and to the annulus above, between the drill string and the side wall of the well bore, generally termed the well bore annulus. The pressure of the drilling fluid as delivered to the cutting elements through the nozzles or other ports or openings must be sufficient to overcome the hydrostatic head at the drill bit, and the flow velocity sufficient to carry the drilling fluid with entrained cuttings through the well bore annulus to the surface.

In a conventional bladed rotary drill bit, there may be a plurality of nozzles, each associated with one or more blades, the nozzles directing drilling fluid to cool and clean cutting elements of the blades. There may also be a plurality of junk slots, positioned between the blades and extending along the gage of the bit, to promote the flow of drilling fluid along each blade through its respective, associated junk slot. However, because the position and angular orientation of each nozzle is usually different relative to the centerline of the bit, and nozzle flow volumes may vary due to the hydraulics of the internal bit passages delivering the drilling fluid to the nozzles, the magnitude and orientation of flow energy of the drilling fluid will vary from one junk slot to the next. Consequently, because a relatively higher flow energy generates an adjacent zone or area of relatively lower hydraulic pressure in the manner of a venturi, drilling fluid emanating from a particular nozzle that would ideally flow past the desired cutting elements of a particular blade and up through the associated junk slot may actually be pulled or drawn downward and even laterally (circumferentially) across the exterior of the blade into a low pressure zone created by a fluid jet of another junk slot. In effect, some junk slots of conventional bits will have a positive or upward flow of drilling mud, while others will have a negative or downward flow resulting from thiefage of a part of the fluid flow by an adjacent junk slot flow zone and destruction of the desired, beneficial flow pattern in the junk slot from which the fluid is stolen. In addition, typical prior art bit designs include stagnant flow regions in and above the junk slots, usually adjacent, behind and above the blades where no appreciable drilling fluid flow, either positive or negative, occurs. These stalled or stagnant flow areas or "dead zones" may be the result of unexpected and undesired vortices that may enhance or even initiate negative flow in some junk slots, or may be the result of bad design which fails to recognize the effect of bit topography on flow of adjacent fluid. If such a disrupted flow pattern occurs, cuttings generated during the drilling process that would normally flow up through the annulus may circulate from a positive flowing junk slot to a negative flowing junk slot, or may accrete in place adjacent or above a blade, the result in either case, particularly at low flow rates, being bit balling as the cuttings mass increases. In other words, these recycling or stationary cuttings impede cutting efficiency of the cutters by obstructing access by the cutting elements to the formation. In addition, stagnant or reduced flow of drilling fluid results in less effective cooling of the cutting elements in those areas where the flow is impaired.

One arrangement to promote clearing of cuttings from a bit has been to position nozzles in the face of the drill bit to direct drilling fluid across the faces of the cutting elements to essentially peel cuttings from the cutting elements, as disclosed in U.S. Pat. No. 4,913,244 to Trujillo. U.S. Pat. No. 4,794,994 to Deane et al. discloses impacting the cutting elements with rearwardly directed fluid flow bounced off of the formation ahead of the cutting elements. Another solution, to remove cuttings from the cutting elements immediately after shearing from the formation by impacting them with a forwardly directed fluid jet from behind the cutting elements, is disclosed in U.S. Pat. No. 4,883,132 to Tibbitts. Such inventive structure is employed in the Chip-Master™ series of drag bits offered by Hughes Christensen Company. Another arrangement for directing fluid flow on the bit face, that of restricting fluid flow on the bit face and directing same through the use of spirally placed dams, is disclosed in U.S. Pat. No. 4,492,277 to Creighton. Yet another approach, to sweep the formation directly with fluid emanating from nozzles on the bit, is disclosed in European Patent Application 0 225 082 to Fuller et al.

In an attempt to more efficiently cut into the formation, variously-configured fluid courses have been devised, including those of U.S. Pat. No. 4,887,677 to Warren et al., which discloses a progressively widening diffuser that allows fluid to be flowed through a narrow throat of a fluid course in front of the cutting element and out a progressively widening diffuser, purportedly resulting in a significantly reduced pressure in front of the cutting elements. U.S. Pat. No. 4,245,708 to Cholet et al. discloses a junk slot having an upwardly directed nozzle placed in a venturi configuration to enhance the flow of drilling fluid through the junk slot. A similar arrangement is disclosed in U.S. Pat. No. 4,540,055 to Drummond et al. in the form of an air-drilling assembly, wherein upwardly aimed nozzles are placed on a sub above a rock bit between and parallel to vanes on the exterior of the sub.

It has also been recognized in the art that creating a flow vortex proximate the cutting elements may be desirable. For example, U.S. Pat. No. 4,733,735 to Barr et al. discloses a rotary drill bit having an exterior surface region adjacent the front surface of each blade and shaped to promote a vortex flow of drilling fluid across the cutting elements of that blade and partial recirculation of the drilling fluid before passage of same from the bit and up the annulus. Similarly, in U.S. Pat. No. 4,848,491 to Burridge et al., it is acknowledged that a bit may be configured to form a vortex to recirculate a portion of the drilling fluid directed into a junk slot by a nozzle.

One of the more elaborate methods and apparatus for removing drilling mud disclosed in U.S. Pat. No. 4,744,426 to Reed includes a downhole motor and "fan" that pulls the drilling mud from around the drill bit. Such a device, however, is a complex mechanical structure and adds to the cost of the drill string. U.S. Pat. No. 5,651,420 to Tibbitts et al., assigned to the assignee of the present invention and incorporated herein by this reference, also discloses a number of movable or dynamic structures for drill bits to assist with cuttings removal and bit cleaning.

U.S. Pat. No. 5,199,511 to Tibbitts discloses a unique bit configuration wherein the flow path from the bit interior to an area above the gage is located within the bit crown, the cuttings entering an interior flow area after being cut, then being swept upwardly by the drilling fluid.

U.S. Pat. No. 5,284,215 to Tibbitts discloses an enlarged and undercut junk slot for enhancing fluid flow, which structure extends upwardly into the bit shank area above the crown.

None of the aforementioned references, however, provide a structure and flow path directing and enhancing positive, independent flow of drilling fluid and entrained cuttings through all of the junk slots of a drill bit, substantially eliminating cross-flow and thiefage between junk slots and minimizing stagnant or dead flow zones in areas within and above the junk slots, which zones promote cuttings accretion and bit balling. Thus, it would be advantageous to provide a drill bit and other drilling-related structures with enhanced hydraulic characteristics affording such advantages.

One such solution to the above-mentioned problems is proposed by U.S. Pat. No. 5,794,725 to Trujillo et al., assigned to the assignee of the present invention and hereby incorporated herein by this reference. This patent provides a recirculation capability in a number of different embodiments, and bits according to the patent have been successful in reducing these problems, although the configuration of the bit, particularly in terms of optimizing its hydraulic design, is somewhat complex.

The aforementioned phenomenon of bit balling has become a more serious problem in recent years with the more widespread use of water-base drilling fluids. Traditional, oil-base drilling fluids have been used with some success for decades to help mitigate the problem of bit balling, but their use is becoming more limited because of environmental concerns. Further, oil-base fluids do not always prevent bit balling. Designing a bit to minimize balling has been, in the prior art, often attempted by using a low number of relatively tall blades carrying a relatively few, relatively large (such as 19 mm or ≈0.75 inch diameter)

PDC cutters, and employing relatively deep (measured radially) junk slots. The low numbers of cutters and blades permits better focus of hydraulic energy, while the tall blades provide a greater standoff from the formation and thus increased spatial volume between the bit face and the formation face, and the deepened junk slots aid removal of formation cuttings past the side of the bit between the gage pads and up into the well bore annulus. It has recently been recognized, as disclosed in U.S. patent application Ser. No. 08/934,031 to Trujillo et al., now U.S. Pat. No. 6,125,947, assigned to the assignee of the present invention and hereby incorporated herein by this reference, that substantially balancing junk slot entrance areas and hydraulic flows associated therewith with formation cuttings volumes generated by blades associated with the respective junk slot hydraulic flows, and carefully apportioning (and in some cases balancing) the formation cuttings volumes between blades, can be beneficial in alleviating bit balling.

However, past work in the field has overlooked a significant characteristic of bit balling which has recently been recognized by the inventor herein: that bit balling originates or initiates at the gage of the bit and not on the bit face. Once the bit gage (i.e, a junk slot) is blocked, the mass of formation cuttings builds back down toward the bit face and onto the face, until the bit completely balls.

Taking into consideration all of the recent improvements offered by the assignee of the present invention, there still remains a substantial, long-felt need in the industry for a rotary drag bit which is substantially resistant to bit balling in plastic formations, and which is capable of achieving a relatively high rate of penetration (ROP) even in normally difficult, slow-drilling formations, such as shales.

BRIEF SUMMARY OF THE INVENTION

The present invention provides a fixed cutter, or rotary drag, bit exhibiting an enhanced resistance to bit balling and an improved rate of penetration, in comparison to conventional bits.

The rotary drag bit of the present invention includes an auger-like blade configuration, wherein positively raked, relatively tall blades carrying superabrasive cutters lean forward in a cantilevered manner in the direction of bit rotation to provide increased clearance and volume between the bit face and the formation to facilitate removal of cuttings coming off the tops of the cutters from the bit face. A trailing outer end of each blade is substantially contiguous with a leading end of an elongated gage pad cantilevered to provide extra junk slot cross-sectional area and comprising a segment of a helix and raked rotationally forwardly in the manner of the blades. The longitudinal lengths of the gage pads and the blades in combination with their rakes provide a stabilizing structure which substantially completely circumferentially encompasses the bit body. The slope or pitch of the helix angle of the gage pads may be varied, as desired, to optimize hydraulic efficiency, requirements of directional drilling, and stability needs. The bit of the present invention also includes nozzles positioned on the bit face proximate, or even partially disposed in, trailing ends of the blades and aimed toward the leading edge of a blade following each respective nozzle to improve cleaning of the blades and to improve the hydraulic energy and fluid velocities along the gage. The bit also preferably includes relatively large, aggressively raked superabrasive cutters having a ground relief on the substrate supporting the superabrasive table rotationally behind the table to minimize contact of the substrate material with the formation.

DETAILED DESCRIPTION OF THE INVENTION

Figure 1A:
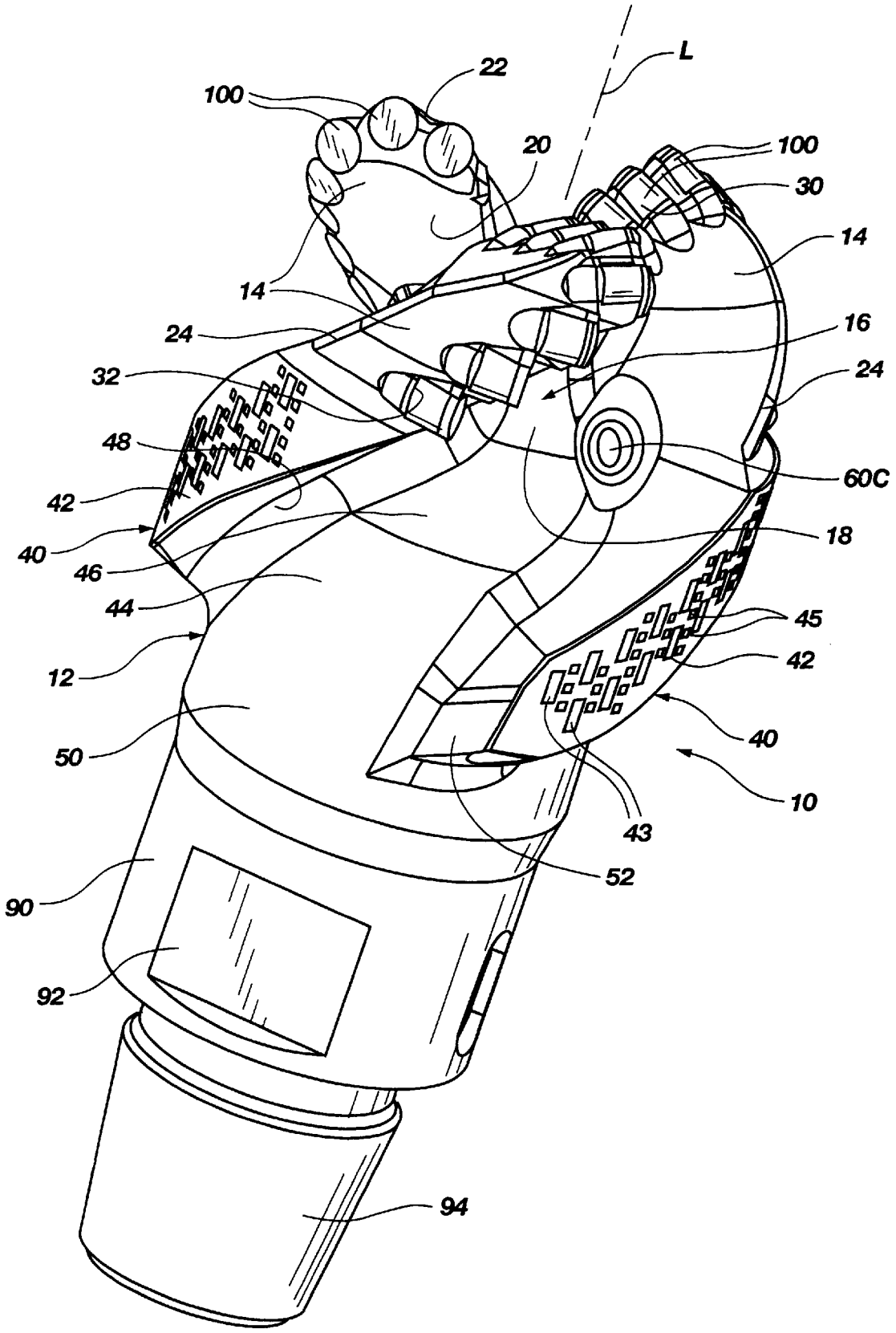
FIGS. 1A and 1B comprise perspective views of an embodiment of a drill bit according to the invention, inverted from its normal drilling orientation for clarity.
Figure 1B:
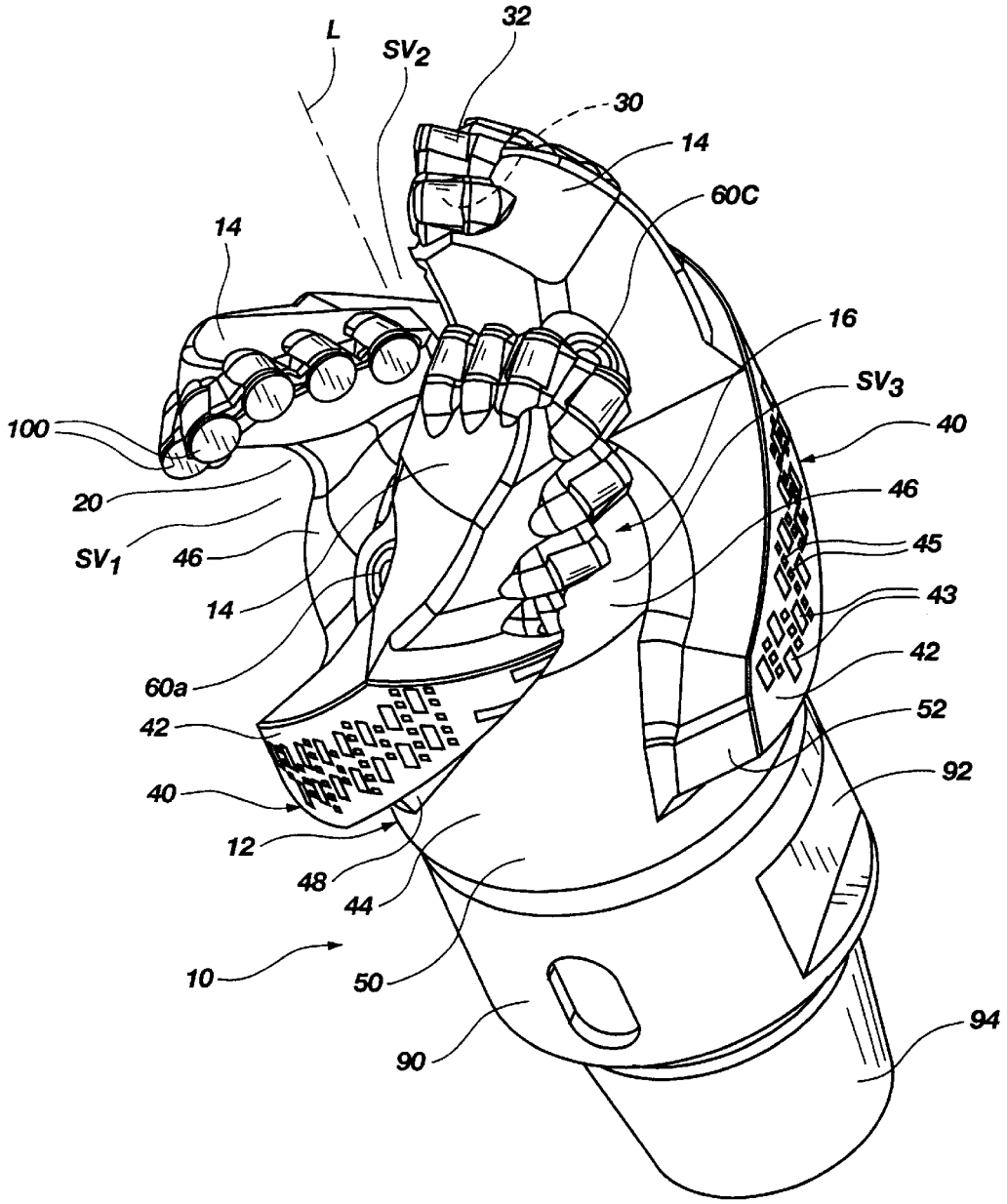

Referring to FIGS. 1 through 4 of the drawings, rotary drag bit 10 according to the invention comprises a bit body 12 having a longitudinal axis or centerline L. Bit body 12 may be a steel body or matrix body as previously described, or of any other suitable construction. In the preferred embodiment, bit body 12 is a matrix bit body. A particularly useful technique for fabricating a matrix bit body 12 (and which can also be applied to steel body bits) is so-called "layered manufacturing", wherein a series of vertically superimposed layers of a material is defined under computer control to form a porous, three-dimensional bit body preform which is subsequently infiltrated with a liquified metal binder as known in the art of matrix-body bit fabrication. U.S. Pat. Nos. 5,43,380 and 5,544,550 to Smith, assigned to the assignee of the present invention and disclosing and claiming a number of such layered manufacturing techniques and bits and bit components produced thereby, are each hereby incorporated herein by this reference.

A plurality of generally radially extending blades 14, three in this instance, protrudes above the bit face 16, defining fluid courses 18 between each blade 14. Fluid courses 18 are extremely steeply angled in comparison to conventional bits, falling away from the longitudinal axis of bit body 12 at about a 45° angle as best appreciated in FIGS. 1A and 2. Blades 14 are not only notably tall, but lean, or are raked, forwardly, taken in the direction of bit rotation. Such a forward rake, in conjunction with the cantilevered nature of the blades, particularly at their radially outer extents, provides an elongated clearance cavity 20 under the rotationally and longitudinally leading, or outermost, edge 22 of each blade 14. Stated another way, at least a portion of each blade 14 overhangs, or leans over, a portion of the fluid course 18 leading that blade. Clearance cavity 20 contributes significantly to the spatial volume $SV_1$, $SV_2$ and $SV_3$, respectively defined between a fluid course 18, two rotationally adjacent blades 14 flanking that fluid course, and the face of a formation being drilled by bit 10. Further, the rotationally forward rake of blades 14 provides added strength in comparison with conventional blades oriented substantially parallel to the centerline or longitudinal axis of a bit, as impact with a hard formation or more likely, a hard stringer as encountered in some soft formations, will be taken more in line with the orientation of the blade 14.

A plurality of superabrasive cutters 100 is mounted to the longitudinally leading edges 22 of each blade 14, cutters 100 being preferably disposed into pockets 30 extending rotationally to the rear of each blade 14 from the leading edge thereof to a trailing wall 32 at the trailing end of the pockets 30. In the preferred embodiment, cutters 100 preferably comprise PDC cutters including a diamond table 102 formed on and bonded to a cemented tungsten carbide substrate 104 (see FIGS. 4A through 4D) under high pressure, high temperature conditions, as is well known in the art. Cutters 100 are generally cylindrical, and pockets 30 are defined by a sidewall of a slightly larger radius than the diameter of substrate 104, a brazing compound (not shown) being employed to secure each cutter 100 by its substrate 104 into its associated pocket 30. Of course, if bit body 12 were a steel body, cutters 100 might be secured to elongated studs, the ends of which would be inserted, as by press fitting, into apertures drilled into blades 14. It is preferred, as shown, that cutters 100 be of limited number and of relatively large diameter, such as 19 mm (≈0.75 inch) or 25 mm (≈1 inch) to optimize hydraulic clearing of each cutter. The cutting faces 106 of cutters 100 are substantially circular, but other shapes, including half-circular, oval, elliptical, rectangular, triangular, and other polyhedral shapes, may also be employed. Circular cutting faces 106 with sharp edges exhibiting neither a significant chamfer or radius are preferred, in accordance with the teachings of U.S. patent application Ser. No. 08/934,486 to Tibbitts et al., now U.S. Pat. No. 6,006,846, assigned to the assignee of the present invention and hereby incorporated herein by this reference. Likewise, extremely smooth, or so-called "polished" cutting faces in accordance with U.S. Pat. Nos. 5,447,208 and 5,653,300 to Lund et al., assigned to the assignee of the present invention and hereby incorporated herein by this reference, are also preferred. As noted with more particularity below with respect to the description of FIGS. 4A through 4E, it is preferred that the substrates 104 of cutters 100 be relieved behind the cutting edge 108 of cutting face 106 to minimize contact with the formation. It is also contemplated that the superabrasive cutters 100 may also include TSPs (for example, in an array or mosaic arrangement), natural diamonds or cubic boron nitride compacts. It is preferred, however, that the superabrasive cutters 100 employed have a cutting face extending in two dimensions substantially transverse to the direction of bit rotation and a cutting edge at an outer periphery of the cutting face.

An elongated gage pad 40 extends substantially contiguously from each blade 14, gage pads 40 each being forwardly rotationally raked in the manner of blades 14 so as to each define a partial segment of a helix. As shown, the gage pads 40 are of substantially constant width transverse to their longitudinal extents and for a substantial majority thereof. The radially outer bearing surfaces 42 of gage pads 40 may be provided with wear-resistant elements such as tungsten carbide bricks 43 (shown as rectangular, but circular or other configurations are entirely suitable) and natural diamond or thermally stable diamond structures 45 or, alternatively, may be provided with hard surfacing such as a plasma-sprayed material, a diamond film surface, or otherwise as known in the art. Junk slots 44, defined between gage pads 40, each communicate with an associated fluid course 18 over a large-radius transition zone 46 also encompassed between adjacent gage pads 40. A portion of each gage pad 40 is cantilevered rotationally forwardly over a portion of its rotationally leading junk slot 44 so as to define a clearance cavity 48 at the rotationally trailing side of that junk slot 44 which communicates with clearance cavity 20 of each blade 40 to enlarge the junk slot cross-sectional area transverse to the direction of flow, while maintaining an enlarged radially outer bearing surface 42. Junk slots 44 enlarge at their lower ends 50 due to truncation at lower end 52 in a longitudinal direction of gage pads 40 to reduce any tendency toward inception of bit balling. Junk slots 44 open onto the exterior of bit shank 90, which may bear breaker flats 92 thereon as shown, above which (as the bit is oriented for drilling) exterior threads 94 (conventionally API threads) form a pin connection suitable for mating with a threaded box connection of a drill collar or motor drive shaft.

The slope, or pitch, of the helix angle of the gage pads relative to longitudinal axis L may be, as noted previously, optimized for hydraulic efficiency, cutter density, requirements of directional drilling, and stability needs.

For example, it has been noted in tests of a bit configured according to the invention that the helical segment configuration of gage pads 40 has, at higher rotational speeds, acted to reduce pressure on the bit face. This indicates that the gage pads, in concert, appear to function like a pump impeller as the bit rotates with respect to the sidewall of the well bore, literally pulling drilling fluid with entrained formation cuttings upwardly off of the bit face and into the well bore annulus. Thus, variation of the gage pad pitch angle may be used to facilitate this pumping action, a shallower pitch resulting in a more significant pumping action at relatively lower rotational speeds. Pitch may be expressed in terms of angle with respect to the longitudinal axis L of the bit 10, or may be expressed in so many degrees of circumferential travel of a gage pad 40 (and associated radially outer edge 24 of a blade 14). For example, a blade (or gage pad) with a 16° per inch pitch would extend circumferentially 16° for every inch of longitudinal elongation. Thus, if a blade or gage pad so pitched extended five inches longitudinally, it would rotate or extend about 80° circumferentially of the bit body 12.

Specific adaptation of the bit according to the present invention to directional drilling, and particularly medium and short-radius drilling, may also be effected by reducing the pitch of the gage pads to shorten bit body 12, thus facilitating turns while retaining the aforementioned stabilization characteristics, as well as fluid and cuttings removal from the bit face.

If stability is a primary concern and directional drilling is not involved, or long-radius drilling only is an objective, the gage pads 40 may be elongated and the pitch thereof made relatively steep to provide enhanced stability, while still retaining some pumping efficiency to enhance fluid removal from the bit face.

The pitch of gage pads 40 and of the radially outer edges 24 of blades 14 can also be optimized to increase the cutter density of the bit. While conventional bit designs either increase blade count or blade height to provide enhanced mounting area (i.e., blade edge length) for cutter mounting, the former of which may compromise bit hydraulics and the latter of which may reduce blade strength under impact, a bit according to the present invention can provide such enhanced mounting area without the addition of blades or an increase in blade height by using a relatively shallow pitch for radially outer blade edges 24 to extend the length thereof, as clearly shown in FIGS. 1A and 1B of the drawings. Thus, a three-blade bit according to the invention may provide, for example, substantially the same cutter density as a four-blade, conventional design.

Figure 2:
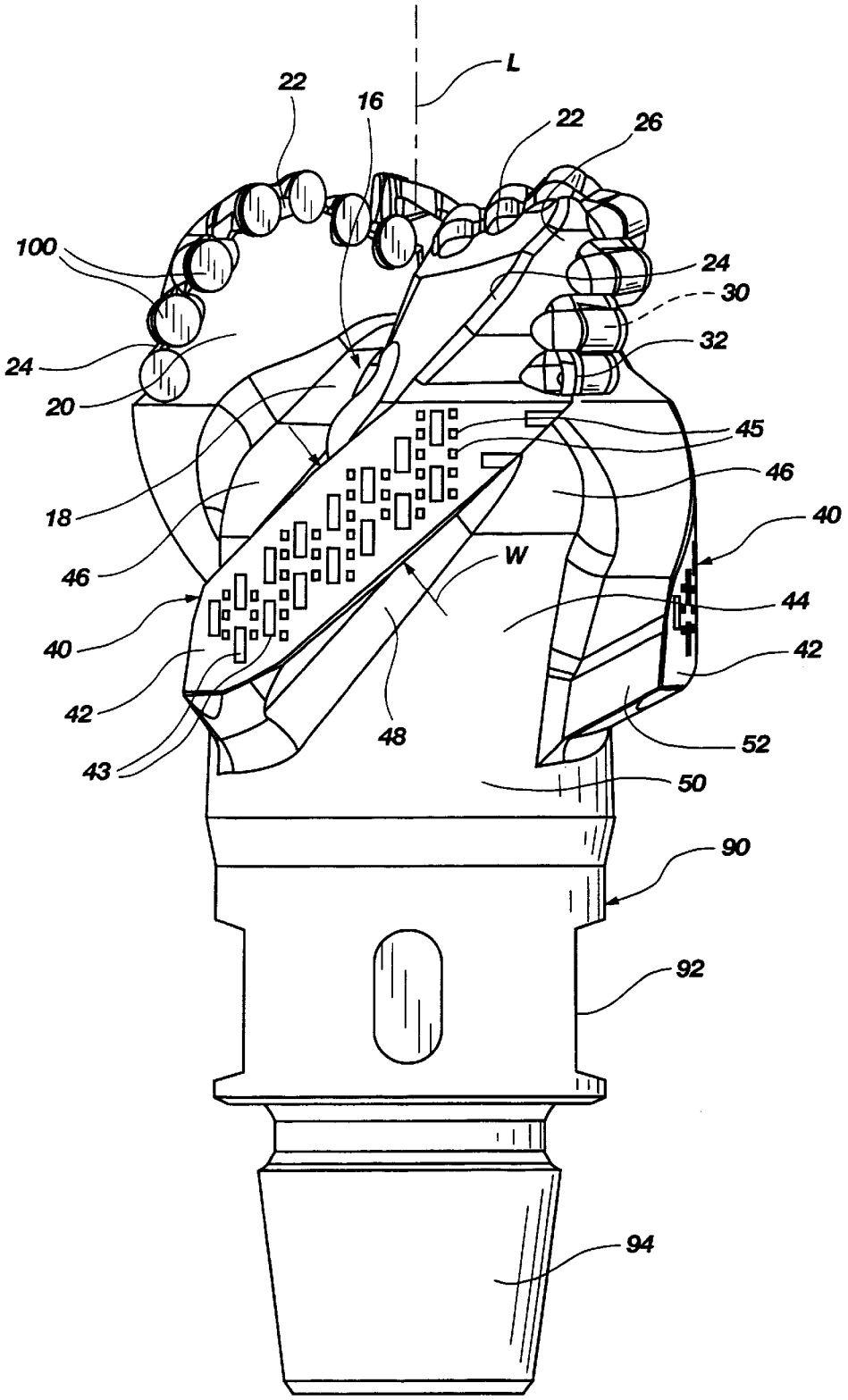
FIG. 2 comprises a side elevation of the bit of FIG. 1, also inverted from its normal drilling orientation.
Figure 3:
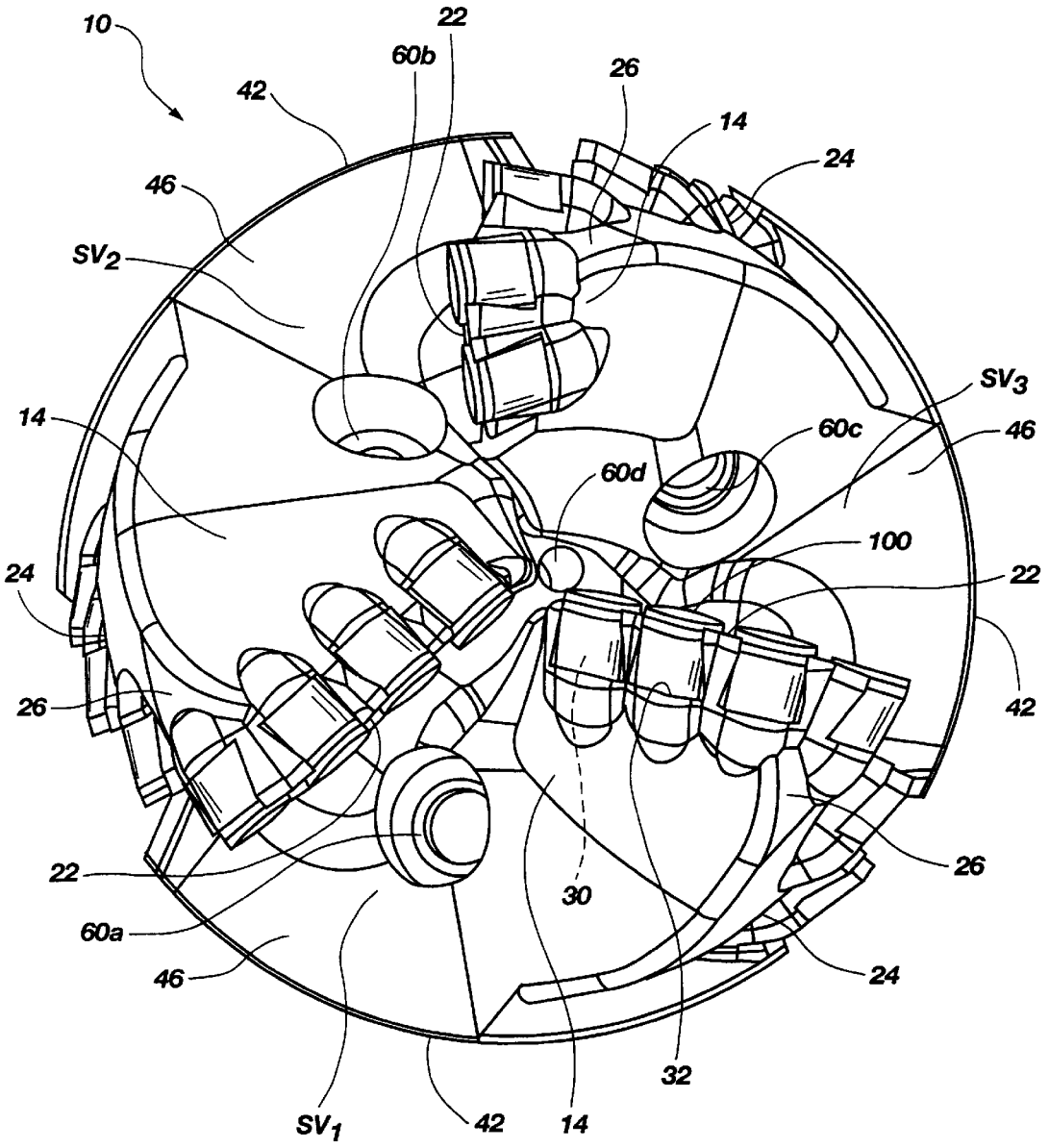
FIG. 3 comprises a frontal, or face, elevation, looking upward at the bit of FIG. 1 as it would be oriented during drilling.
Figure 4A:
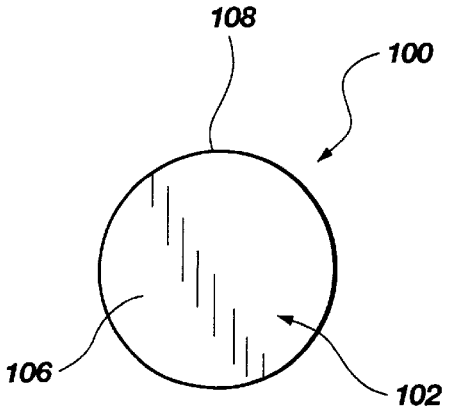
FIGS. 4A through 4E respectively depict frontal, side, top, side sectional and oblique transverse sectional elevations of a superabrasive cutter preferably employed with the bit of the present invention.
Figure 4B:
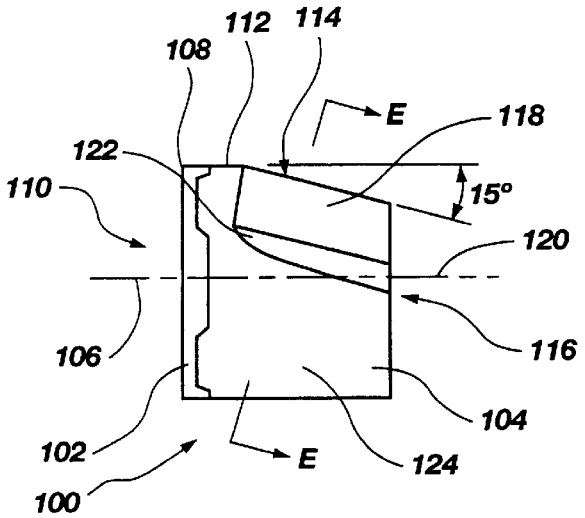
Figure 4C:
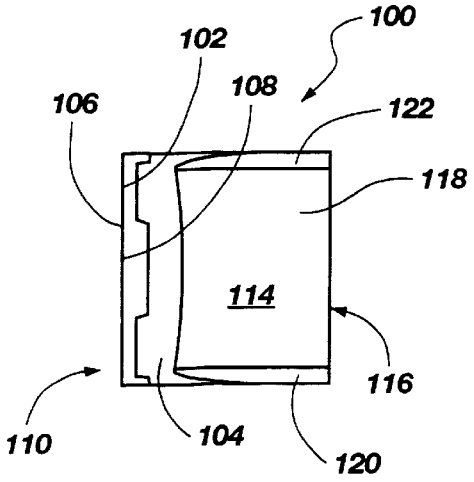
Figure 4D:
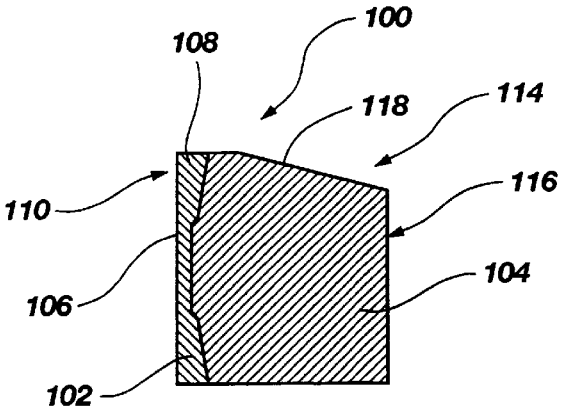
Figure 4E:
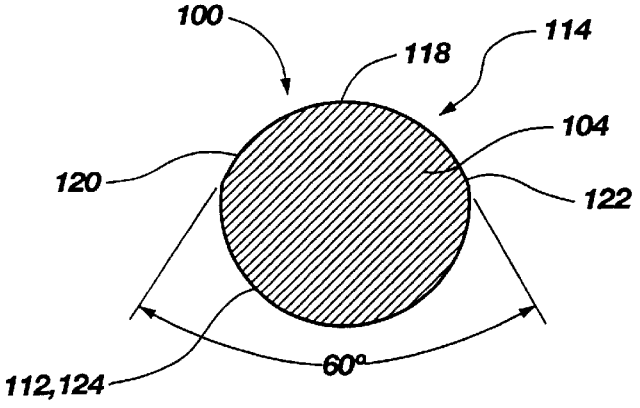

It will be appreciated, particularly with respect to FIGS. 2 and 3, that the radially outer edges 24 of the blades 14 lie substantially radially adjacent radially outer bearing surfaces 42 of gage pads 40, there being a rather marked angular transition 26 between the leading edges 22 of blades 14 and radially outer edges 24. Thus, associated radially outer edges 24 of blades 14 and bearing surfaces 42 of gage pads 40 substantially circumferentially encompass bit body 12. Gage pads 40 themselves afford a circumferentially extending bearing surface exceeding 270°. This large circumferential extent of the gage pads affords, without the necessity of an overly enlarged gage pad or pads, the ability to design a bit according to the present invention as a so-called "anti-whirl" bit. Such bits use an intentionally unbalanced and oriented lateral or radial force vector, usually generated by the bit's cutters, to cause one side of the bit to ride continuously against the sidewall of the sell bore to prevent the inception of bit "whirl", a well-recognized phenomenon wherein the bit precesses around the well bore and against the side wall in a direction counter to the direction in which the bit is being rotated. Whirl can result at the least in an over-gage and out-of-round well bore, and at its worst, in damage to the cutters and bit itself. The large, elongated gage pads of the bit of the present invention provide sufficient bearing area so that an unduly enlarged, dedicated "bearing" gage pad to accommodate the lateral force vector such as is employed in prior art anti-whirl bits is unnecessary. It must be emphasized, however, that the bit of the present invention is entirely suited for designs other than anti-whirl designs, and it is believed that the stability afforded by the cooperative blade and gage pad design of the present invention largely alleviates any need for designing and fabricating a bit according to the present invention as an anti-whirl bit. In accordance with the invention, it is preferred that the gage pads 40 and outer edges 24 of blades 14 provide circumferential envelopment of the bit body 12 of at least 180°, up to and including in excess of 360° (wherein each gage pad and associated radially outer blade bearing surface respectively circumferentially overlaps an adjacent radially outer blade bearing surface and gage pad).

It should also be noted that the enhanced circumferential bearing surface provided by the orientation of the gage pads 40 and blades 14 of bit 10 permits a marked reduction in width W of the gage pads 40 (see FIG. 2) in comparison to conventional bit designs and thus permits a consequent increase in the circumferential area, or width, available for junk slots 44 to further enhance hydraulics and the ability of bit 10 to clear formation cuttings from the bit face 16. Stated another way, the helical segment configuration of gage pads 40 and the radially outer edges 24 of blades 14 provides excellent circumferential coverage of the gage with radial bearing surfaces without wide gage pads. Thus the width of each gage pad is substantially less than the width, measured in the same direction, of each junk slot.

Bit 10 includes four nozzles 60*a*–60*d* thereon, nozzles 60*a,* 60*b* and 60*c* each being disposed over bit face 16 proximate a juncture between each fluid course 18 and the blade preceding that fluid course 18, portions of the apertures in which nozzles 60*a* through 60*c* each reside actually being located in rotationally trailing surfaces of blades 14. Nozzles 60*a* through 60*c* are oriented to be at least partially aimed toward the blade 14 rotationally following that nozzle, such orientation being greatly facilitated by the relatively high (taken longitudinally) position on bit 10. Nozzle 60*d* is disposed substantially centrally on the bit face 16, slightly offset from the centerline or longitudinal axis L of the bit 10. Nozzles 60*a* through 60*c* are each sized to deliver drilling fluid to the fluid courses 18 with which that respective nozzle 60*a,* 60*b,* or 60*c* is associated, substantially in proportion to the relative volume of formation cuttings generated by the cutters 100 on the blade 14 rotationally trailing that fluid course 18, as a percentage of the total formation cuttings volume. In other words, drilling fluid volume is apportioned by nozzles 60*a* through 60*c* between the spatial volumes $SV_1$, $SV_2$ and $SV_3$ in accordance with the relative proportion of formation cuttings volume generated by the respective blades 14 associated with each spatial volume $SV_1$, $SV_2$ and $SV_3$ with respect to the total formation cuttings volume. Substantially centrally located nozzle 60*d* may provide drilling fluid flow to all fluid courses 18, and thus spatial volumes $SV_1$, $SV_2$ and $SV_3$, although nozzle 60*d* may be tilted so as to provide a dominant flow to a particular fluid course 18 and associated spatial volume SV. It should also be noted that, while drilling fluid flow from each of nozzles 60*a* through 60*c* is predominantly radially outward in the fluid course 18 associated with that nozzle, some minimal flow may cross over into another fluid course 18, either across the center of the bit face around a radially inner edge of a blade 14, or under (as the bit is oriented during drilling) a blade 14. The orifice sizes as well as the orientations of each of nozzles 60*a* through 60*d* may be adjusted to minimize such cross-flow through mathematical modeling and empirical testing in a drilling simulator or test well, both such techniques being generally known in the art. In addition, a specific method of flow adjustment employing nozzle orientation disclosed in U.S. Pat. No. application Ser. No. 08/934,031 to Trujillo et al., U.S. Pat. No. 6,125,947, assigned to the assignee of the present invention and incorporated herein by this reference, may be employed to assist in apportioning the volume and direction of flow. The nozzle orientations may also be adjusted to direct more flow toward a cutter or cutters 100 carried by a particular blade 14, which cutters require additional cleaning flow due to the formation cuttings volume generated, as well as reducing flow toward cutters which generate a smaller, or no measurable, cuttings volume. As with flow volumes, formation cuttings volume for a given cutter 100 may be predicted mathematically or tested empirically in a drilling simulator or test well. Mathematical modeling of the flow characteristics of a bit optimized according to the present invention indicates that minor balling or accretion of formation cuttings in one or more junk slots 44 will affect the balance of flow therebetween, but that the inception of balling, unlike in conventional bits, will not lead to aggravated or severe balling with a consequent occlusion of one or more junk slots 44, followed by the fluid courses 18.

Referring now to FIGS. 4A through 4E of the drawings, PDC cutter 100 comprises, as previously mentioned, diamond table 102 formed onto substrate 104, cutter 100 defining a longitudinal extent between the front of the diamond table 102 and the rear of the substrate 104. Diamond table 102 exhibits a circular cutting face 106 having a peripheral cutting edge 108 for engaging the formation. The diamond table 102 and supporting end of substrate 104 may be configured, as shown, in accordance with the disclosure of U.S. patent application Ser. No. 08/935,931 to Scott et al., U.S. Pat. No. 6,202,771, assigned to the assignee of the present invention and hereby incorporated herein by this reference, although this is not a requirement for cutter 100. As may best be appreciated with reference to FIGS. 4B and 4C, substrate 104, while cylindrical proximate its leading end 110 and extending rearwardly therefrom on cylindrical leading sidewall portion 112 for a short distance behind cutting edge 108, is relieved in area 114 further to the rear, extending to trailing end 116. The term "relieved" or "relief" as used herein means that the substrate sidewall lies within an outer envelope defined by the cylindrical sidewall, so as to be laterally or radially recessed from the envelope. The relief, in the preferred embodiment, includes an arcuate surface 118 of like diameter to the diameter of leading sidewall portion 112 proximate leading end 110, but oriented at an acute angle (for example, a 15° angle is shown) to the longitudinal axis 120 of cutter 100.

Longitudinally extending flats 122 flank arcuate surface 118 to ease the transition into trailing cylindrical sidewall portion 124, which is contiguous with leading sidewall portion 112. By way of example only, cutter 100 as shown comprises a 19 mm (≈0.75 inch) diameter cutter. It will be appreciated that the relief in area 114, even when using a slightly negative, a neutral, or even a slightly positive fore and aft rake (also commonly termed "back rake") for PDC cutters 100, minimizes contact area between substrates 104 of PDC cutters 100 and the formation face being engaged by PDC cutters 100. Thus, WOB is concentrated more on the diamond table 102 and leading sidewall portion 112 of each cutter 100, reducing required WOB to achieve a given DOC and reducing friction between bit 10 and the formation and resulting detrimental generated heat and any consequent tendency for heat checking of the substrate as well as heat-induced degradation of the diamond table. In practice, it is contemplated that PDC cutters 100 may be mounted with their cutting faces 106 at a back rake angle of between about 0° and negative 40°. It is currently preferred that the back rake angle be between about 5° and 10° negative. Negative 5° is currently contemplated as being optimum for slow drilling, overpressured shales. PDC cutters 100 may also be mounted with their cutting faces 106 at the aforementioned neutral fore-and-aft rake angle, or even a positive rake angle.

It is expressly contemplated that PDC cutters 100 may be configured with cutting faces of oval, square, tombstone or other suitable configuration.

By way of comparison with conventional bits, an 8.5 inch prototype bit according to the present invention was run in soft shales and weak sands and averaged 60 to 100 feet per hour over large portions of a 1700 foot interval running 0 to 2,000 lbs. WOB. Average ROP for the interval was 41 feet per hour. In comparison, planned ROP for a Hughes Christensen ChipMaster™ bit to be run in the interval was only 12 feet per hour, based on the previous best demonstrated performance in the area in a substantially identical formation and using the same drilling fluid system, as bit balling had proven to be a limiting factor in ROP.

In drilling with a bit according to the present invention and as part of a preferred method of drilling with such bits, it is contemplated that either WOB may be controlled to inhibit bit balling, or bit rotational speed may be increased to enhance the bit's ability to clear formation cuttings as WOB is increased through the aforementioned pumping effect provided by the gage pads. It is further contemplated that, for a given depth of cut and WOB, various rotational speeds will provide an optimum ROP due to the enhanced hydraulics and formation cuttings clearance capability afforded by the bit design of the present invention.

While the rotary drag bit of the present invention has been described in the context of a preferred embodiment, it is not so limited. Those of ordinary skill in the art will recognize and appreciate that many additions, deletions and modifications to the preferred embodiment may be effected without departing from the scope of the invention as defined by the claims which follow.

What is claimed is:

1. A rotary drag bit for drilling a subterranean formation, comprising:

a bit body including a face at a leading end thereof, structure for connecting the rotary drag bit to a drill string at a trailing end thereof, and having a longitudinal axis;

a plurality of generally radially extending blades extending longitudinally from the face, carrying superabrasive cutting structure thereon and being raked forwardly in a direction of intended bit rotation, the plurity of blades defining fluid courses therebetween extending substantially from the longitudinal axis to a periphery of the face;

a plurality of nozzles over the face, at least one nozzle associated with each fluid course; and a plurality of elongated, rotationally, forwardly raked gage pads at a periphery of the bit body, each gage pad being associated with a blade of the plurality of blades and having a longitudinally leading end proximate a rotationally trailing, radially outer end of the blade:

wherein radially outer bearing surfaces of the gage pads extend no less than about 180° circumferentially about the bit body.

2. The rotary drag bit of claim 1, wherein at least a portion of each blade of the plurality of blades is substantially cantilevered over a portion of one of the fluid courses.

3. The rotary drag bit of claim 2, wherein at least a portion of each gage pad of the plurality of gage pads is cantilevered over a portion of a junk slot.

4. The rotary drag bit of claim 1, wherein the at least one nozzle located over the face and associated with each fluid course is aimed toward cutting structure carried by a rotationally trailing blade.

5. The rotary drag bit of claim 1, wherein the plurality of nozzles is sized and oriented, in combination, to apportion a flow of drilling fluid between the fluid courses substantially in proportion to a volume of formation cuttings to be generated by superabrasive cutting structure carried by blades respectively rotationally trailing the fluid courses.

6. The rotary drag bit of claim 1, wherein the superabrasive cutting structure comprises at least one superabrasive cutter having a longitudinal extent and comprising:

a superabrasive table having a cutting face with a cutting edge at a periphery thereof;

a substrate supporting the superabrasive table and including a sidewall having a relieved portion longitudinally remote from the superabrasive table and circumferentially aligned with at least a portion of the cutting edge.

7. The rotary drag bit of claim 6, wherein the at least one superabrasive cutter comprises a plurality of superabrasive cutters.

8. The rotary drag bit of claim 7, wherein cutting faces of at least some of the plurality of superabrasive cutters are negatively back raked at an angle of 40° or less.

9. The rotary drag bit of claim 7, wherein cutting faces of at least some of the plurality of superabrasive cutters are disposed at a neutral fore-and-aft rake.

10. The rotary drag bit of claim 7, wherein cutting faces of at least some of the plurality of superabrasive cutters are forwardly raked.

11. The rotary drag bit of claim 1, wherein the elongated gage pads each comprise a segment of a helix.

12. The rotary drag bit of claim 1, wherein the elongated gage pads are of substantially constant width throughout a majority of their longitudinal extents.

13. The rotary drag bit of claim 1, wherein the elongated gage pads are configured, in combination with a portion of the bit body, to function as an impeller when the bit body is rotated within a well bore.

14. The rotary drag bit of claim 1, wherein the bit body is formed of either steel or a particulate matrix fixed with a binder.

15. The rotary drag bit of claim 1, wherein the superabrasive cutting structure comprises a superabrasive material selected from the group consisting of PDCs, TSPs, natural diamonds, and cubic boron nitride compacts.

16. The rotary drag bit of claim 15, wherein the superabrasive cutting structure comprises cutters having circular cutting faces.

17. The rotary drag bit of claim 16, wherein at least some of the circular cutting faces are at least about 19 mm in diameter.

18. The rotary drag bit of claim 1, wherein each gage pad of the plurality of gage pads is contiguous with a blade of the plurality of blades, and rotationally leading portions of the blades and gage pads are cantilevered.

19. The rotary drag bit of claim 18, wherein the rotationally leading portions of the blades and gage pads define contiguous clearance cavities extending from proximate a radially inner end of each blade to a longitudinally trailing end of each gage pad.

20. The rotary drag bit of claim 1, further including at least one nozzle on the face disposed immediately proximate the longitudinal axis.

21. The rotary drag bit of claim 20, wherein each of the plurality of nozzles is sized and oriented, in combination, to apportion a flow of drilling fluid between the fluid courses substantially in proportion to a volume of formation cuttings to be generated by superabrasive cutting structure carried by blades respectively rotationally trailing the fluid courses.

22. The rotary drag bit of claim 1, wherein radially outer edges of the blades, in combination with the radially outer bearing surfaces of the gage pads extend, in combination, substantially entirely about the bit body.

23. The rotary drag bit of claim 1, wherein the nozzles located over the face and associated with each fluid course are each located adjacent a rotationally trailing portion of a blade rotationally leading the associated fluid course and aimed toward cutting structure carried by a blade rotationally trailing the associated fluid course.

24. The rotary drag bit of claim 23, wherein at least one of the nozzles located over the face and associated with a fluid course is located at least partially within a rotationally trailing portion of a blade of the plurality of blades.

25. The rotary drag bit of claim 1, wherein the gage pads exhibit a width, taken transversely to a direction of elongation, of substantially less than a width, taken at substantially the same orientation, of the junk slots.

26. The rotary drag bit of claim 7, wherein cutting faces of at least some of the plurality of superabrasive cutters are negatively back raked at an angle of 10° or less.

27. The rotary drag bit of claim 7, wherein cutting faces of at least some of the plurality of superabrasive cutters are negatively back raked at an angle of 5° or less.

28. The rotary drag bit of claim 1, wherein a longitudinally trailing end of each gage pad of the plurality of gage pads is truncated, the truncated longitudinally trailing ends of two adjacent gage pads providing the enlarged circumferential width at the lower end of a junk slot disposed between the two adjacent gage pads.

29. A rotary drag bit for drilling a subterranean formation, comprising:

a bit body including a face at a leading end thereof, structure for connecting the rotary drag bit to a drill string at a trailing end thereof, and having a longitudinal axis;

a plurality of generally radially extending blades extending longitudinally from the face, carrying superabrasive cutting structure thereon and being raked forwardly in a direction of intended bit rotation, the blades defining fluid courses therebetween extending substantially from the longitudinal axis to a periphery of the face;

a plurality of nozzles over the face, at least one nozzle associated with each fluid course; and a plurality of elongated, rotationally forwardly raked gage pads at a periphery of the bit body, each gage pad being associated with a blade of the plurality of blades and having a longitudinally leading end proximate a rotationally trailing, radially outer end of the blade;

wherein radially outer bearing surfaces of the gage pads and the blades extend, in combination, no less than about 180° circumferentially about the bit body to in excess of 360° about the bit body.

30. A rotary drag bit for drilling a subterranean formation, comprising:

a bit body including a face at a leading end thereof, structure for connecting the rotary drag bit to a drill string at a trailing end thereof, a shank portion disposed between the face and the structure at the trailing end, and having a longitudinal axis;

a plurality of generally radially extending blades extending longitudinally from the face, carrying superabrasive cutting structure thereon and being raked forwardly in a direction of intended bit rotation, the blades defining fluid courses therebetween extending substantially from the longitudinal axis to a periphery of the face;

a plurality of nozzles over the face, at least one nozzle associated with each fluid course;

a plurality of elongated, rotationally forwardly raked gage pads at a periphery of the bit body, each gage pad being associated with a blade of the plurality of blades and having a longitudinally leading end proximate a rotationally trailing, radially outer end of the blade; and a plurality of junk slots, each junk slot defined between two adjacent gage pads of the plurality of gage pads and having an upper end communicating with one of the fluid courses and a lower end opening onto a region surrounding the shank portion of the bit body, the lower end of each junk slot exhibiting an enlarged circumferential width relative to a circumferential width of the upper end thereof;

wherein radially outer bearing surfaces of the gage pads extend no less than about 180° circumferentially about the bit body.

31. The rotary drag bit of claim 30, wherein radially outer edges of the blades, in combination with the radially outer bearing surfaces of the gage pads extend, in combination, substantially entirely about the bit body.

32. The rotary drag bit of claim 30, wherein the elongated gage pads are configured, in combination with a portion of the bit body, to function as an impeller when the bit body is rotated within a well bore.

33. A rotary drag bit for drilling a subterranean formation, comprising:

a bit body including a face at a leading end thereof, structure for connecting the rotary drag bit to a drill string at a trailing end thereof, a shank portion disposed between the face and the structure at the trailing end, and having a longitudinal axis;

a plurality of generally radially extending blades extending longitudinally from the face, carrying superabrasive cutting structure thereon and being raked forwardly in a direction of intended bit rotation, the blades defining fluid courses therebetween extending substantially from the longitudinal axis to a periphery of the face;

a plurality of nozzles over the face, at least one nozzle associated with each fluid course;

a plurality of elongated, rotationally forwardly raked gage pads at a periphery of the bit body, each gage pad being associated with a blade of the plurality of blades and having a longitudinally leading end proximate a rotationally trailing, radially outer end of the blade; and a plurality of junk slots, each junk slot defined between two adjacent gage pads of the plurality of gage pads and having an upper end communicating with one of the fluid courses and a lower end opening onto a region surrounding the shank portion of the bit body, the lower end of each junk slot exhibiting an enlarged circumferential width relative to a circumferential width of the upper end thereof;

wherein radially outer bearing surfaces of the gage pads and the blades extend, in combination, no less than about 180° circumferentially about the bit body to in excess of 360° about the bit body.

* * * * *

UNITED STATES PATENT AND TRADEMARK OFFICE

CERTIFICATE OF CORRECTION

PATENT NO. : 6,302,223 B1
DATED : October 16, 2001
INVENTOR(S) : L. Allen Sinor

It is certified that error appears in the above-identified patent and that said Letters Patent is hereby corrected as shown below:

Title page,
Item [56], References Cited, OTHER PUBLICATIONS, after "Bits," change "Hughts" to -- Hughes --

Column 2,
Line 48, change "side wall" to -- sidewall --

Column 6,
Line 24, after "or" and before "of" insert -- be --

Column 9,
Line 10, change "sell" to -- well --

Column 12,
Line 4, change "plurity" to -- plurality --
Line 14, change ":" to -- ; --

Column 16,
Line 7, after "the" and before "gage pads" insert -- plurality of --.

Signed and Sealed this

Nineteenth Day of August, 2003

JAMES E. ROGAN
*Director of the United States Patent and Trademark Office*